US006568327B1

(12) United States Patent
Jones et al.

(10) Patent No.: US 6,568,327 B1
(45) Date of Patent: May 27, 2003

(54) TRADING CARD HAVING POSTAL MARKINGS AND METHOD FOR PRODUCING SAME

(75) Inventors: Guy Jones, Voorhees, NJ (US); James Stefano, Moorestown, NJ (US)

(73) Assignee: Fleer/Skybox International, LP, Mount Laurel, NJ (US)

( * ) Notice: Subject to any disclaimer, the term of this patent is extended or adjusted under 35 U.S.C. 154(b) by 0 days.

(21) Appl. No.: 09/627,538

(22) Filed: Jul. 28, 2000

(51) Int. Cl.[7] ..... B42D 15/00
(52) U.S. Cl. ..... 101/483; 283/67
(58) Field of Search ..... 101/483; 229/71; 705/407, 401, 404; 206/59, 459; 283/62, 67, 79, 71, 82, 114; 40/124, 124.09

(56) References Cited

U.S. PATENT DOCUMENTS

| | | | | |
|---|---|---|---|---|
| 3,692,233 A | * | 9/1972 | Carter, Jr. | 229/71 |
| 3,830,422 A | * | 8/1974 | Dunn | 229/71 |
| 4,012,857 A | * | 3/1977 | Leskovec, Jr. | 40/124 |
| 4,641,578 A | * | 2/1987 | Versaci | 101/483 |
| 5,075,862 A | * | 12/1991 | Doeberl | 283/71 |
| 6,018,774 A | * | 1/2000 | Mayle et al. | 709/250 |
| 6,082,774 A | * | 7/2000 | Schlauch | 283/67 |

OTHER PUBLICATIONS

Marlyn Monroe First Day Issue Covers (Issued By Fleetwood Windriver Studioes Cheyenne Wyoming) Jun. 1, 1995 (Set of 5).*

James Dean Commerative Envelopes Set (Issued By Fleetwood) Jun. 24, 1996 (5 Envelopes).*

V.–J. Day Commemorative Postcards (Issued By Stamp Vault Winter 1996 Issue) Page 4.*

Bucky Dent Memorabilia Envelope published before Jul. 28, 2000.

National ALS Foundation, Inc.–Lou Gehrig Memorabilia Envelope published before Jul. 28, 2000.

All Star Sporrs Series–Reggie Jackson Memorabilia Card published before Jul. 28, 2000.

* cited by examiner

*Primary Examiner*—Eugene H. Eickholt
(74) *Attorney, Agent, or Firm*—Stephen H. Eland; Dann, Dorfman, Herrell and Skillman

(57) ABSTRACT

A trading card and method for producing a trading card are provided. The trading card includes a picture printed on a substrate. The card is mailed to obtain a postmark printed on the card from the postal service. Preferably, a date and/or location is selected to correspond with an event associated with the picture on the card. The trading card is then mailed to obtain a postmark having a date and/or location corresponding with the selected date and/or location. After the card is mailed it may be trimmed to a smaller size. More specifically, the card may be trimmed to a size having a length and/or height that is smaller than the minimum height and/or length allowed for mailing under postal regulations. The mailed cards are then packaged either individually or with other mailed or unmailed cards.

35 Claims, 1 Drawing Sheet

TRADING CARD HAVING POSTAL MARKINGS AND METHOD FOR PRODUCING SAME

FIELD OF THE INVENTION

The present invention relates to printed trading cards, such as baseball, football or basketball trading cards having a picture of a sports figure. More specifically, the present invention relates to trading cards on which a postmark is printed, which relates to the date and/or location of an event associated with the person printed on the trading card.

BACKGROUND

Trading cards, such as baseball cards have been sold and collected by individuals for generations. Typically sports trading cards have a picture of a sports figure along with information about the individual's career, such as batting average, number of career home runs or number of strike-outs. In recent years trading cards have become quite popular and are collected and traded as memorabilia items. In addition, the demand for trading cards has prompted a number of premium quality cards having special features. For instance, trading cards having multiple layers to produce a three-dimensional visual effect have been produced. In addition, trading cards having hologram images have been produced, as well as trading cards in which a piece of memorabilia, such as a piece of bat or jersey, is attached to the trading card. Despite the presence of several types of premium quality trading cards, there exists a demand for premium quality trading cards having novel and unusual features.

SUMMARY OF THE INVENTION

In light of the foregoing, the present invention provides a trading card have a postmark printed on the card. Preferably the postmark has a date and location corresponding to an event associated with the picture on the trading card. The trading card is produced by applying a picture, such as a sport figure's picture, to a card and obtaining a postmark on the card. Preferably the card is sized to conform to the length and height of postcards permitted for mailing by the United States postal regulations. After the card is mailed, a portion of the card may be severed to form a trading card with a postmark thereon. More specifically, the postcard may be severed so that the height of the card is shorter than the minimum height of postcards permitted for mailing by United States postal regulations and/or the length of the card is shorter than the minimum length of postcards permitted for mailing by United States postal regulations. After the card is trimmed, the card may be packaged, such as by wrapping the card in sheet material to enclose the card.

DESCRIPTION OF THE DRAWINGS

The foregoing summary as well as the following detailed description of the preferred embodiments will be best understood when read in conjunction with the following drawings, in which.

DETAILED DESCRIPTION OF THE PREFERRED EMBODIMENTS

Figure 1:
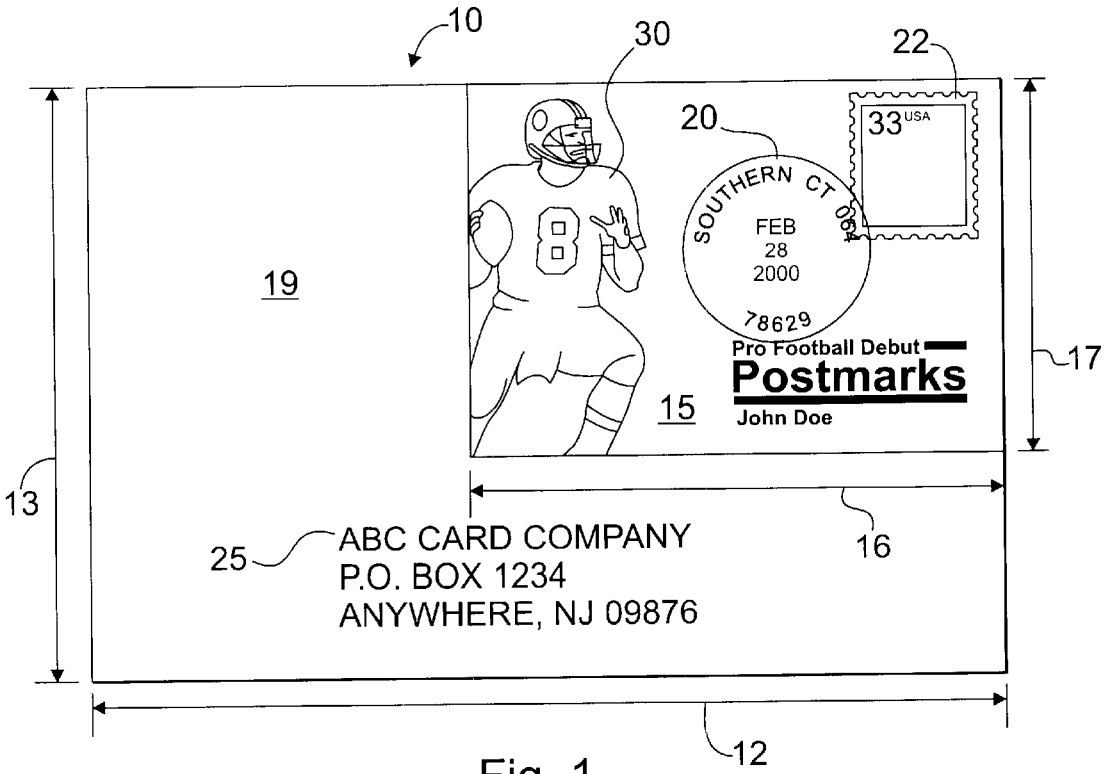
FIG. 1 is a front view of a trading card embodying aspects of the present invention.

Referring now to the figures in general, and to FIG. 1 specifically, a trading card is designated generally 10. A picture of an individual 30, such as a sports figure or entertainment figure, is printed on the front of the card 10. Postage 22 is applied and the trading card is sent through the mail to obtain a postmark 20. Preferably, the postmark 20 is selected so that the date and/or location printed on the postmark correspond to an event associated with the individual printed on the post card. For instance, the individual may be a rookie football player, and the postmark 20 may be selected so that the date and location are the same as the date and location of the player's first professional football game. After the trading card 10 is mailed, it may be trimmed to a different length and/or height.

Referring again to FIG. 1, the trading card 10 will be described in greater detail. The trading card 10 comprises a substrate onto which a picture 30, such as an individual's picture is printed. The picture 30 may be any of a variety of types of pictures. For instance, the picture may be of a sports figure, such as a baseball, basketball or football player, a race car driver, or an entertainer, such as a superhero, movie star or character from a movie or television show.

The card 10 has a length 12 and a height 13. Preferably, the length and height are selected to fall within the minimum and maximum length and heights under the United States postal regulations for postcards. Presently, the maximum length under the regulations for postcards is 6 inches and the minimum is 5 inches; and the maximum height is 4.25 inches and the minimum is 3.5 inches. Preferably, the length 12 is approximately 6 inches and the height 13 is approximately 4 inches. Furthermore, preferably, the trading card has a thickness of between approximately 0.007 inches and 0.016 inches. In addition, preferably the ratio of the length 12 to the height 13 is between approximately 1.3 and 2.5.

Postage 22 is applied to the card 10. The postage 22 may be any of several accepted forms, such as a postage stamp adhered to the card, or postage printed onto the card by a postage machine. An address 25 to where the postal service will deliver the card 10 is also printed on the card. The card 10 is then mailed by the United States Post Office, so that a postmark 20 is printed or stamped on the card. Typically, the postmark 20 is stamped on to the card so that the postmark overlaps the postage 22. The postmark 20 includes a city and date. Preferably, the city and date of the postmark correspond to a location and date of an event associated with the individual in the picture 30.

After the card 10 is mailed, preferably the card is trimmed to the dimensions of a typical trading card. Specifically, preferably, the card is printed so that the picture 30 and printed information about the individual, such as statistics, are printed in a predefined portion of the card, which will be referred to as the trimmed card 15, having a length 16 and a height 17. In addition, preferably the postage 22 and postmark 20 are applied to the trimmed card 15 portion of the card 10. After being mailed, the trimmed card 15 is cut out from the card 10. Preferably, the delivery address 25 is printed on the waste portion 19, so that the delivery address does not appear on the trimmed card 15.

Figure 2:
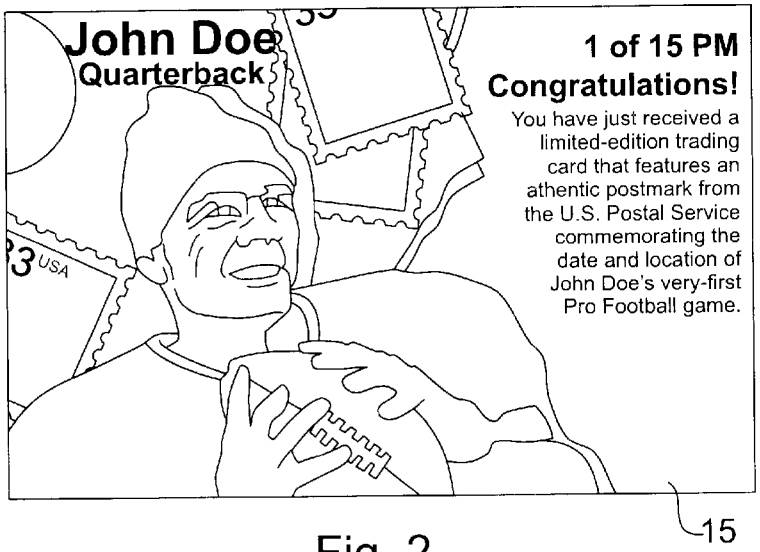
FIG. 2 is a back view of a portion of the trading card illustrated in FIG. 1.

Preferably, the card 10 is formed in the following manner. Picture 30 is printed onto a substrate formed of paper and/or plastic. The picture 30 is printed in the trimmed card portion of the card. Additionally, an additional picture and/or information may be printed on the back side or reverse side of the card corresponding to the trimmed portion 15, as shown in FIG. 2. Postage 22 is applied to the trimmed card 15 portion adjacent the picture 30. Preferably, the card is printed so that there is limited or no printing in the area where the postage is applied, so that the postmark is readily discernible.

The delivery address 25 is also printed on the card 10. Preferably, the delivery address is selected so that it corresponds to the same company sending the card 10. In this way, the company mails the card 10 to itself.

The term mail or mailed as used herein encompasses any of a number of Postal Service delivery techniques. For instance, the term mail includes the process in which an item is marked with a delivery address, the appropriate postage is applied and the item is deposited with the Postal Service. The Postal Service then stamps the item with a postmark and delivers the item to the delivery address marked on the item. Further, the term mail includes the process in which the appropriate postage is placed on each of a number of items, which are then deposited with the Postal Service. The Postal Service stamps each item with a postmark, and places all of the postmarked items into a container, so that all of the pieces are delivered together in the container. Further, the term mail includes the process in which the appropriate postage is placed on each of one or more items, which are then deposited with the Postal Service. The Postal Service stamps each item with a postmark and returns the item(s) to the sender without sending the items through the ordinary delivery system. Accordingly, the term mail includes any process by which the Postal Service affixes a marking having a date and/or location, such as a postmark, on an item to indicate that the item was processed by the Postal Service.

After the card 10 is printed and postage 22 is applied, the card is deposited with the Postal Service. As part of the postal delivery service, the Postal Service stamps the card 10 with a postmark 20. Preferably, the card 10 is deposited with the postal service so that the postmark 20 includes a date and/or location corresponding to an event associated with the picture 30 on the card. Further, the date and/or location of the event associated with the picture 30 on the card is preferably also printed on the card so that the date and/or location printed is the same or similar to the date and/or location of the postmark.

The date and location for the postmark may be selected as follows. The card 10 may be produced prior to the date of the event associated with the picture, such as the date of a rookie's first professional game. The card 10 can then be deposited with the postal service on the day associated with the event and in the city in which the event occurs. Optionally, one or more post office locations are authorized to print the postmark with any city that has a post office. Further, such a post office may print the postmark with a specified date other than the date on which the piece of mail is deposited with the post office, as long as the piece of mail is deposited within a particular window of time. For instance, the post office may print the postmark with a particular date as long as the date is within the thirty days preceding the date the piece of mail is deposited with the post office. For example, if a sender deposits the piece of mail on September 21$^{st}$, the sender may request that the mail be postmarked with the date of September 4$^{th}$. In this way, the sender can select the date (within a set of dates) and the location to be printed on the postmark by the postal service.

After the mail is received, the postmarked card may be further modified if desired. Preferably, the card 10 is trimmed along its length and along its height to sever portion 19, leaving only the trimmed card 15. Preferably this trimming step severs the delivery address 25 from the card. In other instances, it may be desirable not to trim the card.

After the card 10 is trimmed, if desired, the card is packaged in one of several ways. For instance, preferably, the trimmed card 25 is packaged by wrapping the card in thin sheet material such as foil wrapping, and the wrapping is sealed to enclose the card. Other known wrapping materials such as paper or plastic cellophane can be used.

The cards can be individually wrapped if desired. However, preferably the cards are stacked together with other cards and the stack is packaged together. More specifically, preferably the mailed cards are limited-edition premium feature cards that are sorted with unmailed cards that are generally the same height and length as the card after it is trimmed, if desired. More specifically, preferably, the unmailed cards are sorted into stacks and packaged together. A mailed card is randomly sorted together with the unmailed cards. Preferably, the mailed cards are inserted into the stacks of the unmailed cards so that most of the stacks of cards do not have a mailed card. For instance, the mailed cards may be inserted randomly into stacks of unmailed cards at a rate of one mailed card for approximately every 50, 100 or 200 stacks of unmailed cards.

The mailed cards may also be packaged together as a premium memorabilia item. For instance, a mailed card may be framed. In addition, sets of mailed cards may be packaged together. For instance, a series of mailed cards having a unified theme may be produced. One example would be a series of rookie cards for all first round rookies in a certain season. The cards are postmarked with the date and location of each rookie's first professional game of the season. After the cards are mailed, they are placed together in a frame, so that the entire series is framed.

The terms and expressions which have been employed are used as terms of description and not of limitation. There is no intention in use of such terms and expressions of excluding any equivalents of the features shown and described or portions thereof. It is recognized, however that various modifications are possible within the scope and spirit of the invention as set forth in the following claims.

What is claimed is:

1. A method for producing trading cards, comprising the steps of:

providing a card of a size conforming to the length and height of postcards permitted for mailing by United States postal regulations;

applying a portrait of a sports or entertainment individual to a card;

selecting a date relative to an event associated with the individual;

selecting a location relative to the event associated with the individual;

placing postage on the card;

obtaining a postmark having a date and location corresponding to the selected date and location; and severing a portion of the card after it is postmarked to form a trading card with a postcard thereon.

2. The method of claim 1 comprising the step of mailing the postcard to obtain a postmark having a date and location that is the same as the selected date and location.

3. The method of claim 1 comprising the steps of:

providing a stack of trading cards; and sorting the postmarked card into the stack of trading cards.

4. The method of claim 1 comprising the step of wrapping the postmarked card with sheet material to enclose the postmarked card.

5. The method of claim 1 wherein the severing step comprises severing a portion of the card along the length of the card and severing a portion of the card along the height of the card.

6. The method of claim 1 wherein the step of severing comprises severing the card so that height of the card is shorter than the minimum height of postcards permitted for mailing by United States postal regulations.

7. The method of claim 1 wherein the step of severing comprises severing the card so that the length of the card is shorter than the minimum length of postcards permitted for mailing by United States postal regulations.

8. The method of claim 1 comprising the steps of:

providing a plurality of unmailed trading cards; and selectively stacking the postmarked card with the unmailed trading cards.

9. The method of claim 8 comprising the step of packaging the postmarked card and unmailed trading cards together in the same package.

10. The method of claim 1 comprising the steps of:

printing a delivery address on the card; and severing a portion of the card on which the delivery address is printed, after the card is postmarked.

11. A method for producing trading cards, comprising the steps of:

producing a trading card according to the following steps:

applying a picture of an individual on a card;

identifying an action of the individual;

printing information on the card identifying the action;

selecting one of a date or a location relative to the individual's action;

placing postage on the card;

selecting a postmark having one of either a date or a location corresponding to the selected date or location; and applying the select postmark to the card;

providing a plurality of postmarked cards in accordance with the above step of providing a trading card;

providing a plurality of stacks of unmailed trading cards; and selectively inserting the postmarked card into the stacks so that the ratio of stacks having mailed cards and stacks without mailed cards corresponds to a predetermined ratio.

12. The method of claim 11 comprising the step of selecting the other of the date or the location relative to the event associated with the individual, and printing on the card a postmark having the other of the selected date or location.

13. The method of claim 11 comprising the step of wrapping the postmarked card with sheet material to enclose the postmarked card.

14. The method of claim 11 comprising the step of packaging the postmarked and unmailed cards together in the same package.

15. The method of claim 11 wherein the step of printing a postmark comprises printing on the card a postmark having one of either a date or a location that is the same as the selected date or location.

16. The method of claim 11 comprising the step of cutting the card to a size conforming to the length and height of postcards permitted for mailing by United States postal regulations.

17. The method of claim 11 comprising severing the postmarked card so that its height is approximately 2½" and its length is approximately 3½".

18. A method for producing trading cards, comprising the steps of:

applying a picture of an individual on a card;

selecting one of a date or a location relative to an event associated with the individual;

placing postage on the card;

selecting a postmark having one of either a date or a location corresponding to the selected date or location;

applying the select postmark to the card; and severing a portion of the card after the card is postmarked.

19. The method of claim 18 comprising the step of:

printing a delivery address on the card;

wherein the step of severing comprises severing a portion of the card on which the delivery address is printed, after the card is postmarked.

20. The method of claim 18 comprising the step of severing a portion of the card along the length of the card and severing a portion of the card along the height of the card.

21. The method of claim 18 wherein the step of severing comprises severing the card so that the height of the card is shorter than the minimum height of postcards permitted for mailing by United States postal regulations.

22. The method of claim 18 wherein the step of severing comprises severing the cards so that the length of the card is shorter than the minimum length of postcards permitted for mailing by United States postal regulations.

23. A method for producing trading cards, comprising the steps of:

applying a picture of an individual to a card;

obtaining a postmark on the card;

severing a portion of the postmarked card; and packaging the postmarked card to enclose the postmarked card.

24. The method of claim 23 wherein the step of packaging comprises wrapping the postmarked card with sheet material to enclose the postmarked card.

25. The method of claim 23 comprising the step of selecting a date associated with the picture, wherein the step of obtaining a postmark comprises printing on the card a postmark having the selected date.

26. The method of claim 25 comprising the step of printing the date on the card when the picture is printed.

27. The method of claim 23 comprising the step of printing a delivery address on the card, wherein the step of severing severs a portion of the card on which the delivery address is printed, after the card is postmarked.

28. The method of claim 23 wherein the step of severing comprises severing the card so that the height of the card is shorter than the minimum height of postcards permitted for mailing by United States postal regulations.

29. The method of claim 23 wherein the step of severing comprises severing the cards so that the length of the card is shorter than the minimum length of postcards permitted for mailing by United States postal regulations.

30. The method of claim 23 comprising the steps of:

providing a plurality of unmailed trading cards; and selectively stacking the postmarked card with the unmailed trading cards.

31. The method of claim 30 wherein the step of packaging encloses the postmarked and unmailed cards together in the same package.

32. The method of claim 23 comprising the step of selecting a location associated with the picture, wherein the step of mailing comprises printing on the card a postmark having the selected location.

33. The method of claim 32 comprising the step of printing the date on the card when the picture is printed.

34. The method of claim 23 comprising the step of cutting the card to a size conforming to the length and height of postcards permitted for mailing by United States postal regulations.

35. The method of claim 23 wherein the step of severing comprises severing the postmarked card so that its height is approximately 2½" and its length is approximately 3½".

* * * * *